United States Patent [19]

Isogaya

[11] 4,279,740

[45] Jul. 21, 1981

[54] LIGHT-MATERIAL SEGREGATING METHOD AND APPARATUS

[75] Inventor: Keiichi Isogaya, Shizuoka, Japan

[73] Assignee: Marusho Industrial Co., Ltd., Tokyo, Japan

[21] Appl. No.: 122,797

[22] Filed: Feb. 19, 1980

[30] Foreign Application Priority Data

Feb. 19, 1979 [JP] Japan ..... 54/20867[U]

[51] Int. Cl.[3] ..... B03C 7/04; B07B 9/02

[52] U.S. Cl. ..... 209/12; 209/20; 209/129; 209/138; 209/466

[58] Field of Search ..... 209/12, 19, 20, 127 R, 209/127 B, 129, 133, 138, 139 R, 140, 141, 147, 466–469, 471–472

[56] References Cited

U.S. PATENT DOCUMENTS

| | | | |
|---|---|---|---|
| 794,647 | 7/1905 | Sutton et al. | 209/12 |
| 1,588,881 | 6/1926 | Evans | 209/133 |
| 1,720,861 | 7/1929 | Stebbins | 209/20 |
| 2,009,928 | 7/1935 | Henry | 209/133 |
| 2,722,312 | 11/1955 | Gear | 209/19 |
| 2,947,416 | 8/1960 | Ross | 209/12 X |
| 3,349,902 | 10/1967 | Lafranca, Jr. et al. | 209/127 R X |
| 3,831,748 | 8/1974 | Berkowitz et al. | 209/12 |

*Primary Examiner*—William A. Cuchlinski, Jr.
*Attorney, Agent, or Firm*—Sughrue, Rothwell, Mion, Zinn and Macpeak

[57] ABSTRACT

An apparatus and method for separating light and heavy materials from one another. Materials to be separated are transported on a conveyer belt past a set of overhead rollers. Air is sucked through gaps between the rollers with covers surrounding groups of rollers which are coupled to a suction pump. Air is jetted through apertures in the conveyer belt to loosen adherence between lighter materials and larger articles. A high voltage is impressed upon the rollers to provide electrostatic attraction for light dry materials. The rollers may be provided with opposing protrusions which are used to pinch off certain materials.

12 Claims, 5 Drawing Figures

LIGHT-MATERIAL SEGREGATING METHOD AND APPARATUS

BACKGROUND OF THE INVENTION

The present invention relates to a method for segregating relatively light weight materials from relatively heavy weight materials.

In the case where first materials of relatively equal weight are mixed with second materials which are heavier or lighter than the first materials, techniques for segregating the first and second materials using a sifter or a flow of air have usually been employed. Such techniques are effective when the first and second materials are greatly different in weight from each other and are different in absorptivity. However, such techniques are generally ineffective in the case where unwanted materials to be removed are mixed with articles such as vegetables or fish which are soft and are likely to be intermixed or where unwanted materials adhere to other articles such as caused by static electricity.

The inventor has previously disclosed an apparatus for segregating unwanted materials from such articles in Japanese Utility Model Application No. 102778/1978. This apparatus will be described with reference to FIG. 1. A number of rollers 2 having relatively large diameter and to which is applied to a high voltage are rotatably arranged above a vibrating conveyor 1. The mouths of a suction device are provided near the upper portions of the rollers so that unwanted materials mixed with articles are picked up on the lower surfaces of the rollers and are then sucked away so as to separate them from the articles.

The apparatus according to this utility model performs quite excellently in that its work efficiency is high and the apparatus can treat processed foods which cannot be treated by the above-described conventional segregation techniques which use a sifter or a flow of air. However, the apparatus is still disadvantageous in that the weight or range of properties of unwanted materials segregated by the apparatus are somewhat limited. More specifically, the material to be removed must be light in weight so that it may be sucked onto the surface of the roller 2. When a material such as yarn or soft hair having a simple configuration is picked up by the roller (removal of such a material being often required in the field of food manufacture), it tends to remain stuck to the roller surface and therefore it is difficult to remove by suction with the result that the work efficiency of the apparatus is very much lowered. Furthermore, light weight materials often float between the conveyor and the rollers. That is, they are not picked up on the roller surfaces and are therefore not removed.

SUMMARY OF THE INVENTION

Accordingly, an object of the invention is to thus provide a light weight material segregating method and apparatus in which all of the above-described difficulties accompanying conventional techniques have been eliminated and which is applicable to segregation of a variety of materials.

According to one aspect of the invention, a number of rollers having a relatively small diameter are arranged parallel to one another with a relatively short distance between them in such a manner as to form slits therebetween. The rollers are covered with suction ducts which generate flows of air rising from a conveyor toward the suction ducts whereby materials relatively light in weight are sucked in and segregated by the air flows. According to another aspect of the invention, high voltage is applied to the rollers to generate a force which attracts relatively light weight materials so as to assist the operation of the air flow in segregating the materials thereby to effectively segregate heavy or soft materials which cannot be segregated by only the air flow or by only the attractive force of the charged rollers.

DESCRIPTION OF THE PREFERRED EMBODIMENTS

Figure 1:
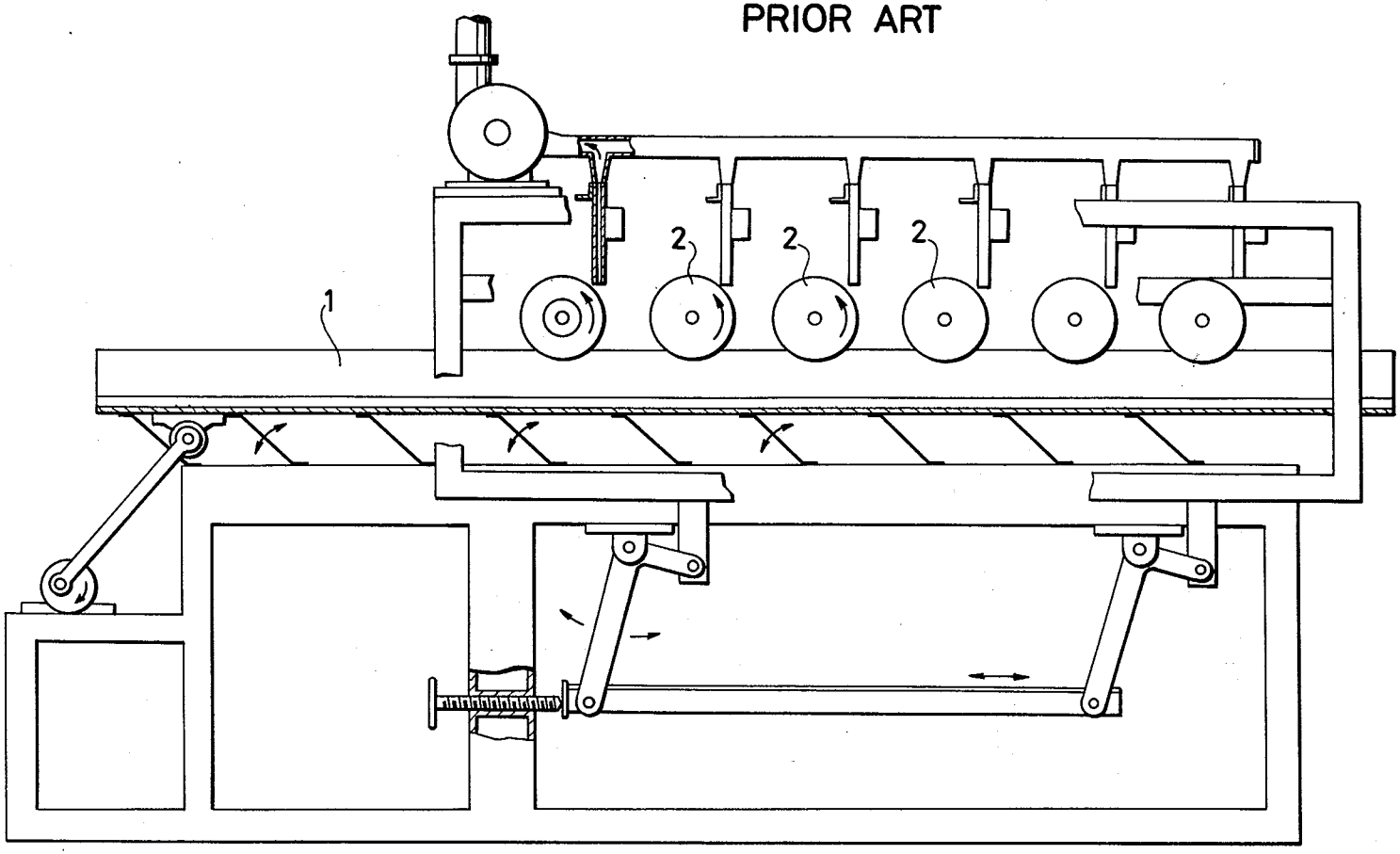
FIG. 1 PRIOR ART
FIG. 1 is a side view showing a conventional apparatus for segregating light materials from heavy materials.
Figure 2:
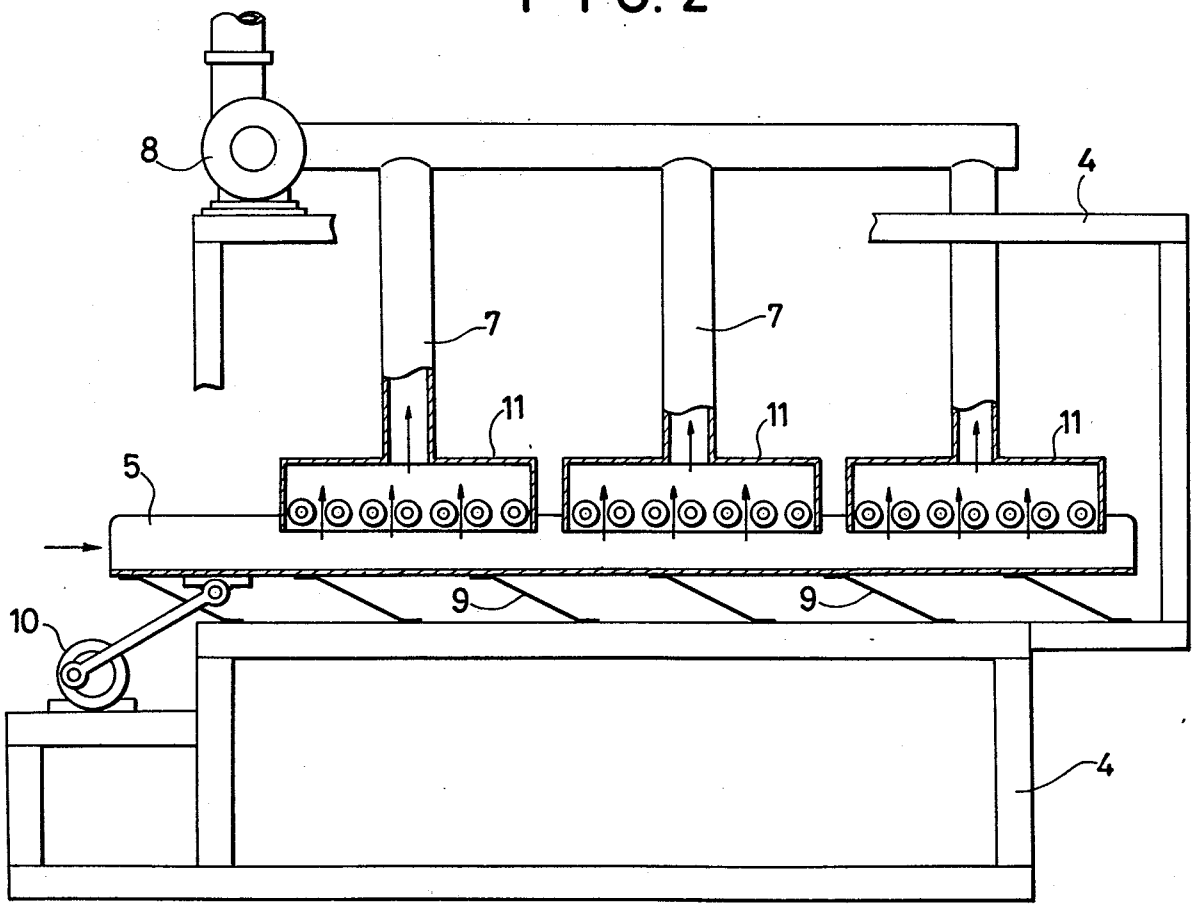
FIGS. 2 and 3 are side views showing a preferred embodiment of the invention.
Figure 3:
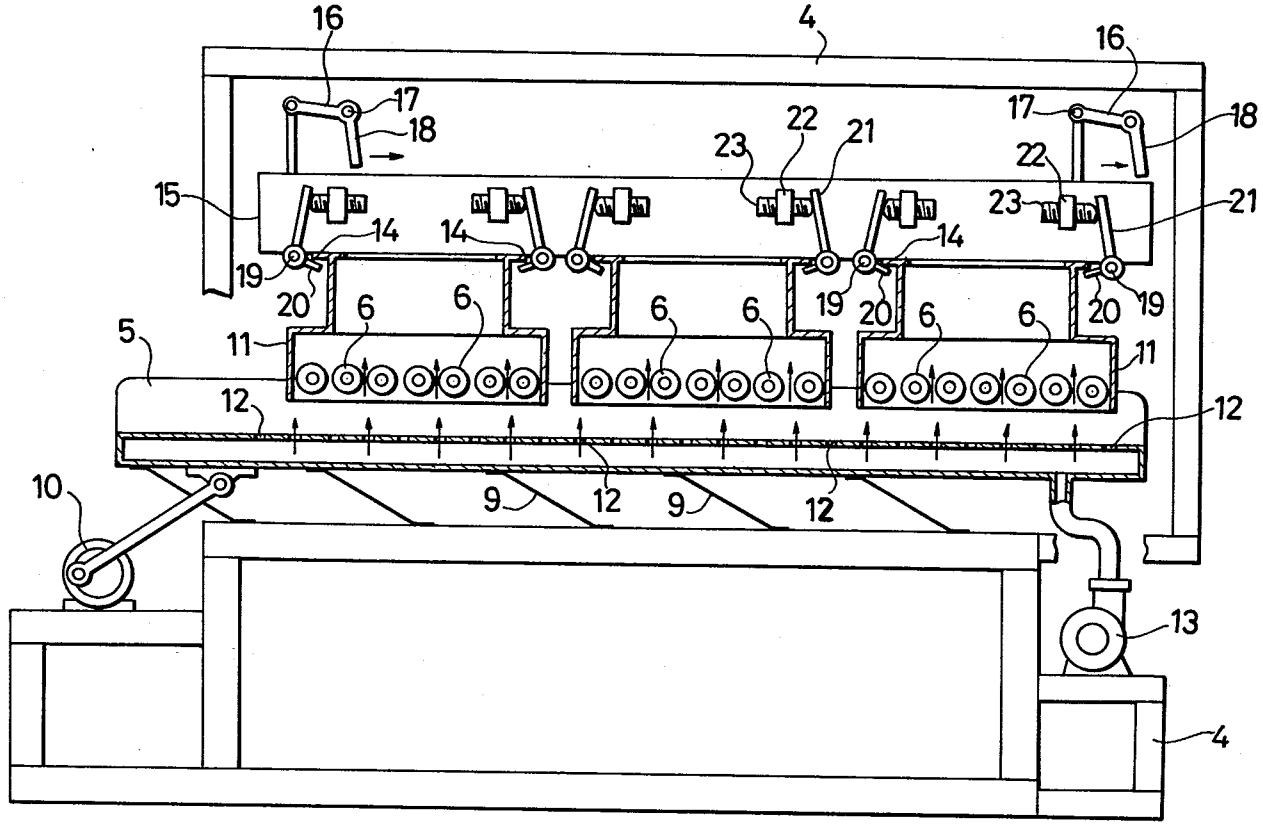

A preferred embodiment of the invention will be described with reference to FIGS. 2 through 5. FIG. 2 shows the fundamental arrangement of a light material segregating apparatus according to the invention. This includes a frame 4, a belt conveyor 5, rollers 6 and suction ducts 7. The rollers 6 are arranged parallel to one another with a relatively small spacing of about 5 to 30 mm therebetween. Each suction duct 7 has a large mouth at its lower end which covers corresponding ones of the rollers 6. In other words, the rollers 6 form a grid in the mouths of the suction duct 7 with the gaps between adjacent rollers serving as slits through which air flows. The ducts 7 are connected to a suction pump 8. Air sucked by the suction pump 8 is delivered into a collecting device, not shown. The rollers 6 are so designed and operated such that either all of the rollers are rotated in the same direction of the rotational direction of every other roller is opposite to that of its adjacent rollers. A high voltage is applied to the rollers. The conveyor 5 operates to convey articles from which unwanted materials lighter in weight than the other articles should be removed under the rollers thereby allowing the unwanted materials to separate from the articles. In order to improve the segregation performance, it is desirable that the conveyor be not only capable of conveying articles but also capable of vibrating the articles up and down so that the articles are detached from one another and the articles are set upside down. For this purpose, the conveyor is preferably a vibrating conveyor as shown in FIG. 2.

FIG. 2 shows also a preferred technique for vibrating the conveyor 5. The conveyor is supported on the frame 4 through several leaf springs 9 and is coupled to a crank mechanism 10 at one end. The conveyor is vibrated up and down by operation of the crank mechanism 10. As described before, the suction duct 7 has a large mouth designated by reference numeral 11 which extends over several rollers 6 in such a manner that the rollers are housed in the large mouth 11 and form a grid in the large mouth 11. Air sucked through the suction duct 7 passes through the gaps between rollers as a result of which the flow velocity of the air increases and accordingly the suction force is also increased.

The operation of the apparatus thus constructed will be described. First, the crank mechanism 10 is operated to vibrate the conveyor 5 while the suction pump 8 is operated to generate a flow of air moving upwardly from the surface of the conveyor. Under these conditions, articles to be treated are placed on the loading end of the conveyor 5. The articles are slowly moved forward while being vibrated and separated from one another by the conveyor. When they reach the region covered by the rollers 6, the light weight materials mixed with the articles are forced to move upwardly with the flow of air through the suction duct whereby the materials are segregated from the articles. In this connection, it goes without saying that the gap width between the conveyor 5 and the rollers 6 affects the segregation performance. As the rollers 6 are lowered decreasing the gap between the conveyor 5 and the rollers 6, the segregation efficiency is increased for heavier materials.

In the case where the materials to be segregated from articles have a relatively low water contact percentage such as powdered substances and hair, the segregation efficiency is remarkably improved by applying a high voltage to the rollers to provide an electrostatic force between the rollers and the conveyor, thus attracting the lighter materials. In the case where the materials to be segregated from articles have a relatively high water content percentage such as for instance vegetables or have relatively large volume, the segregation efficiency can be improved by jetting air from the surface of the conveyor. This will be described with reference to FIG. 3. Here, the conveyor 5 has been modified to be a hollow conveyor having a number of jetting holes 12 on the surface thereof. An air blower 13 is coupled to the hollow conveyor 5 and air is delivered under pressure into the hollow chamber formed in the conveyor 5 so as to be jetted upward through the jetting holes 12 and to thereby to blow upwards the light materials on the conveyor.

Even if, in this case, both of the materials lighter and heavier in weight being segregated are dry and are attracted to one another by static electricity, they will be moisturized by the air jetted through the holes and accordingly the attractive force therebetween will be released.

Next, an example of a mechanism for lifting the rollers 6 will be described. Each cover 11 adapted to cover the rollers is in the form of a box opened at the bottom. The rollers 6 are arranged in the box-shaped cover 11. Locking protrusions 14 are provided on the edges of the top of the cover 11. A hanging frame 15 is mounted on the apparatus frame 4 in such a manner that it can be moved up and down as desired. Accordingly, the rollers may be moved up and down by moving the hanging frame 15 up and down.

This mechanism will be described in more detail. Supporting shafts 17 are horizontally mounted at the upper portion of the frame 4 and arms 16 are rotably mounted on the supporting shafts 17. First ends of the arms 16 are coupled to the hanging frame 15 and the other ends of the arms 16 are connected to operating levers 18, respectively. The frame 15 may be moved vertically by turning the operating levers 18. Shafts 19 are horizontally mounted on the hanging frame 15 and engaging protrusions 20 are rotatably mounted on the shafts 19. An operating lever 21 is connected to and made integral with each engaging protrusion 20. Nuts 22 are secured to one side of the frame 15 and bolts 23 are screwed into the nuts 22 in such a manner that the ends of each of the bolts 23 is in engagement with a corresponding one of the operating levers 21. The covers 11 are coupled to the hanging frame 15 as follows. The locking protrusions 14 are held between the engaging protrusions 20 and the lower surface of the hanging frame 15. Then, the bolts 23 are rotated to turn the operating levers 21 thereby causing the engaging protrusions 20 to engage with the locking protrusions 14.

Figure 4:
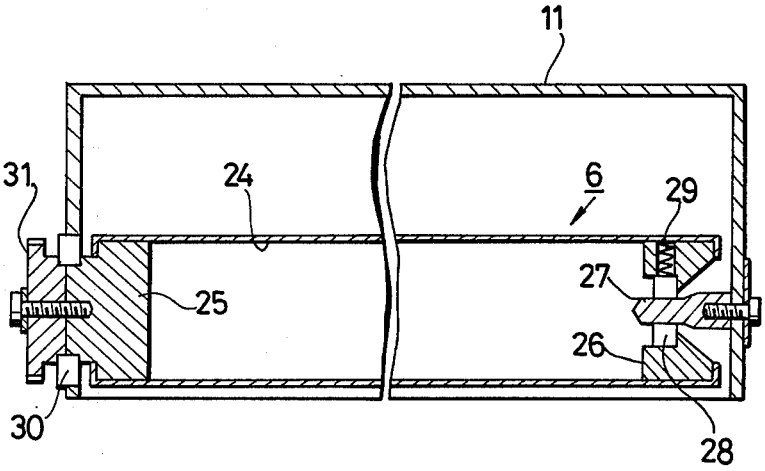
FIG. 4 is a vertical sectional view showing a roller mounted in a cover according to the invention.

An example of the construction of the rollers 6 will be described with reference to FIG. 4. Insulating supporting members 25 and 26 are inserted into both end portions of a wire cylinder 24 which is assembled by covering the outer surface of a cylinder, formed by winding an electrical wire in the form of a coil, with an insulating material. A bearing 28 is secured at the center of the supporting member 26 and the bearing 28 is electrically connected to the wire cylinder 24 through a coil spring 29. Further, an insertion hole is formed in one side of the cover 11 which is made of an insulating material. A supporting protrusion 27 made of metal is provided on the inner surface of the opposite side of the cover 11 at a position opposite to the insertion hole with the protrusion 27 electrically extending outside of the cover 11.

The roller 6 can be mounted in the cover 11 as follows. The roller 6 is inserted into the cover 11 through the insertion hole formed in the side of the cover with the supporting protrusion 27 being thus inserted into the bearing 28. Still further, a bearing 30 is disposed between the insertion hole and the supporting member 25 so that the roller 6 is rotatably mounted in the cover 11 and removal of the roller is prevented. A gear 31 is secured to the supporting member 25. The gear 31 is engaged with a gear secured to the next adjacent roller 6 so that the rotational force is transmitted between rollers.

Figure 5:
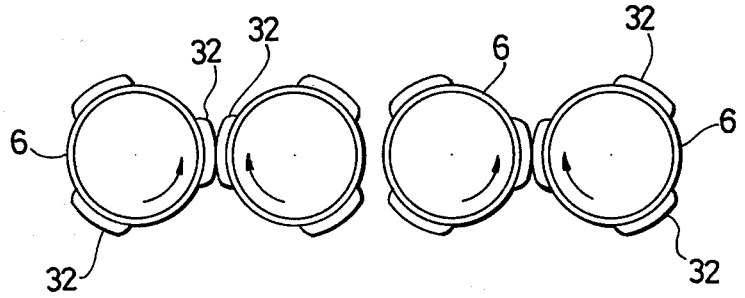
FIG. 5 is a front view showing a modification of a roller used with the invention.

In the case where the materials to be separated from the articles are flexible, thin and long as for the case of hair, it may be difficult to segregate the materials from the articles because, even if one end of such a piece of material is sucked between the rollers, the other end may still adhere to the articles. This difficulty may be overcome by the use of rollers 6 which are formed as shown in FIG. 5. The rollers 6 have a number of protrusions 32 on their surfaces. The protrusions 32 are so arranged by cooperation with the intermeshing gears coupled to the rollers that the protrusions of adjacent rollers are always at symmetrical angular positions so that they are periodically brought into contact with each other. With the rollers thus formed, flexible, thin and long materials such as hair will be pinched between the protrusions 32 and thus pulled away from the articles.

As is apparent from the above description, in accordance with the invention, a number of relatively thin rollers are arranged in the form of a grid and are disposed inside covers which are connected to a suction pump so that air flows between the rollers at a relatively high speed whereby light materials mixed with articles which are transported by the conveyor are removed. That is, the light materials are segregated from the articles. In addition, the rollers are so designed that a high voltage is applied thereto to attract such light materials. Because of the combination of the attractive force due to the high voltage and the suction force produced by the flow of air at high velocity, the efficiency of segregating light materials from articles is considerably increased.

What is claimed is:

1. A method for separating light and heavy materials from one another comprising the steps of:

transporting materials to be separated on a conveyor past a set of parallel rollers;

applying a high voltage to said rollers;

rotating said rollers; and sucking air through gaps between said rollers during rotation of said rollers, wherein said step of sucking air through gaps between said rollers comprises sucking air through covers disposed around upper portions of predetermined groups of rollers.

2. The method of claim 1 further comprising the step of jetting air through apertures in said conveyor towards said rollers.

3. The method of claim 1 further comprising the step of pinching materials between protrusions formed on said rollers.

4. The method of claim 1 further comprising the step of vibrating said conveyor.

5. Apparatus for separating light and heavy materials comprising:

a conveyor for transporting materials to be separated;

a plurality of rollers disposed adjacent a portion of an upper surface of said conveyor, a predetermined gap being left between adjacent ones of said rollers;

a cover disposed around said rollers and having an open portion on the side of said conveyor;

means for applying a high voltage to said rollers;

means for rotating said rollers; and a suction pump coupled to, and operable to suck air through, said cover, said rollers being disposed in groups and wherein said cover comprises a plurality of cover sections, one of said cover sections covering a corresponding group of rollers.

6. The separating apparatus of claim 5 further comprising means for applying a high voltage to said rollers.

7. The separating apparatus of claim 5 or 6 wherein said conveyer has a plurality of air jet apertures formed therein and further comprising means for blowing air through said air jet apertures towards said rollers.

8. The separating apparatus of claim 5 wherein said rotating means rotates adjacent ones of said rollers in the same direction.

9. The separating apparatus of claim 5 wherein said rotating means rotates adjacent ones of said rollers in opposite directions.

10. The separating apparatus of claim 5 wherein said rollers further comprise protrusions, said rollers cooperating with said rotating means wherein protrusions of adjacent rollers are periodically in abutment with one another.

11. The separating apparatus of claim 5 wherein said rollers are mounted on said cover and further comprising means for varying the vertical position of said cover and said rollers.

12. The separating apparatus of claim 5 further comprising means for vibrating said conveyer belt.

* * * * *